United States Patent [19]

Pavincic

[11] Patent Number: 4,541,643

[45] Date of Patent: Sep. 17, 1985

[54] TWO WHEEL SKATING DEVICE

[76] Inventor: Ivan Pavincic, East Rutherford, Bergen, N.J. 07073

[21] Appl. No.: 507,736

[22] Filed: Jun. 27, 1983

[51] Int. Cl.[4] ..... A63C 17/14

[52] U.S. Cl. ..... 280/11.21; 280/11.25; 280/11.27

[58] Field of Search ..... 280/11.21, 11.25, 11.2, 280/11.27, 11.28, 11.19, 701; 188/30, 82.84, 74

[56] References Cited

U.S. PATENT DOCUMENTS

| | | | |
|---|---|---|---|
| 336,600 | 2/1886 | Tennent | 280/11.19 |
| 824,108 | 6/1906 | Fulton | 280/11.25 |
| 1,393,813 | 10/1921 | Muck | 280/11.19 |
| 1,632,997 | 6/1927 | Connolly | 280/11.19 |
| 2,165,996 | 7/1939 | Chiles | 280/11.21 |
| 2,507,980 | 5/1950 | Knapp | 280/701 |
| 2,552,987 | 5/1951 | Loertz | 280/11.28 |
| 2,727,603 | 12/1955 | Rauen | 188/30 |
| 4,076,266 | 2/1978 | Krausz | 280/11.2 |
| 4,289,323 | 9/1981 | Roberts | 280/11.21 |

FOREIGN PATENT DOCUMENTS

| | | | |
|---|---|---|---|
| 654100 | 12/1937 | Fed. Rep. of Germany | 280/11.28 |
| 2455192 | 5/1976 | Fed. Rep. of Germany | 280/11.21 |
| 2632555 | 2/1978 | Fed. Rep. of Germany | 280/11.2 |
| 2727657 | 1/1979 | Fed. Rep. of Germany | 280/11.21 |
| 9648 | of 1897 | United Kingdom | 280/11.21 |

*Primary Examiner*—David M. Mitchell
*Assistant Examiner*—Mark C. Dukes

[57] ABSTRACT

The two wheel skating device of the present invention contains two large size wheels with each over four inches in diameter. The wheels are symmetrically arranged on opposite sides of a frame which accommodates a skater's shoe. The wheels are rotationally mounted on axles coaxially extending from opposite sides of a swinging arm which is pivotally connected to the frame. Each wheel is rotationally mounted through a wheel assembly including unidirectional needle bearings for rotation in only one direction.

7 Claims, 6 Drawing Figures

TWO WHEEL SKATING DEVICE

This invention relates to a two wheel skating device for personal transportation, recreation or sport competition and for use on any surface composition.

Conventional skates use four small wheels each under three inches in diameter which are symmetrically arranged about a frame to which the wheels are rotatably connected for free wheeling motion in both clockwise and counterclockwise directions. To move forward or backward the skater must shuffle the skates in a zig-zag like pattern such that, e.g., when one skate is moved forward the other is turned at an angle to the direction of forward movement to provide a support against which the skater can apply a force. This shuffling motion and the small diameter of the wheels limits the use of conventional skates to a relatively flat and smooth surface.

Roller skates with less than four wheels are also known. Such devices have been constructed in the past in a manner to duplicate the performance of the four wheel skate and have all of the limitations of the four wheel skate as well as others.

The skate device of the present invention is a two wheel skate with each wheel over four inches in diameter. The skate device may turn a corner by merely distributing the weight of the skater's body so as to apply a turning force upon either the inside or outside wheel of each skate relative to the opposite wheel. This is based upon a skate design which permits free wheeling motion of each skate wheel in only one direction. Accordingly, the skater does not have to zig-zag to cause forward movement. The skate design and large wheel size permits the skater to skate up an incline and does not limit skating to any given skating surface. In fact, the skater can skate on a grass surface.

It is accordingly the principle object of the present invention to provide a two wheel skating device which is capable of free wheeling in only one direction.

It is a further object of the present invention to provide a two wheel skating device which permits turning without lifting either of the skater's feet off the ground.

It is an even further object of the present invention to provide a two wheel skate which permits skating over any surface and upon almost any grade level.

These and other objects and advantages of the present invention will become apparent from the following detailed description of the invention when read in conjunction with the accompanying drawings of which:

Figure 1:
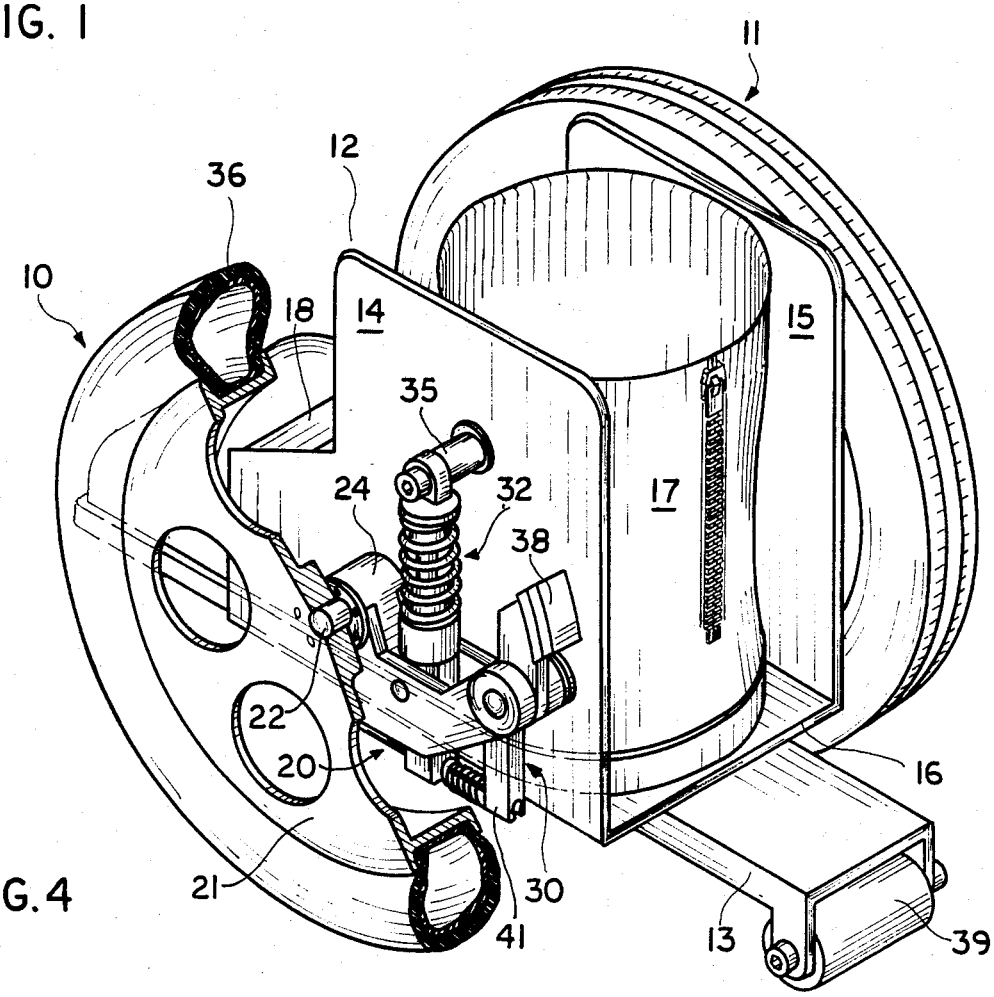
FIG. 1 is a rear perspective view of the two wheel skate device of the present invention.
Figure 4:
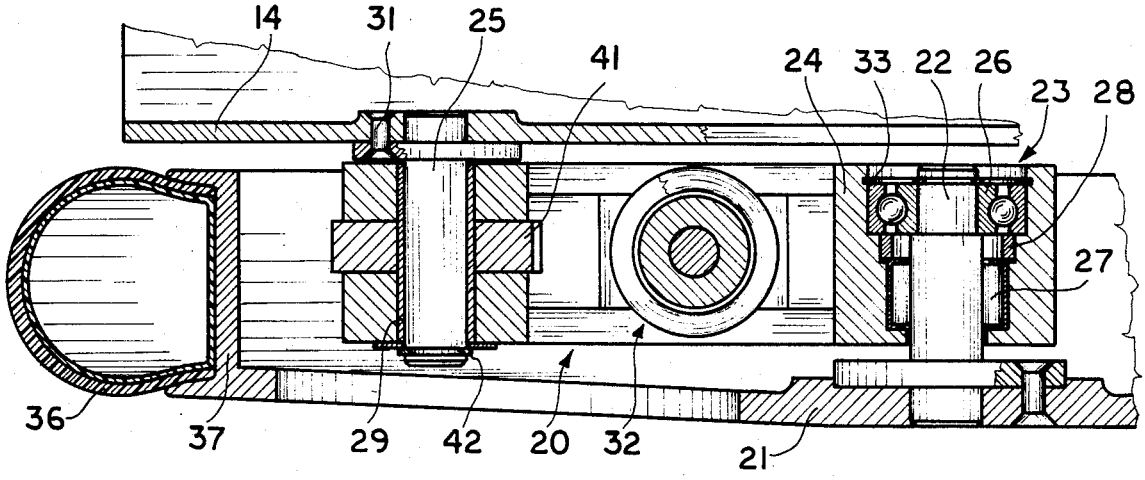
FIG. 4 is an enlarged partial cross section of the two wheel skate device taken along the lines 4—4 of FIG. 3.

The skate device of the present invention is illustrated in FIGS. 1–4 inclusive consisting of two wheels 10 and 11 rotationally mounted on opposite sides of a frame 12. The frame 12 includes two side walls 14 and 15 extending upright from a level platform 16 of appropriate dimensions to accommodate a skater's shoe 17. A bar 18 is supported between the side walls 14 and 15 of the frame 12 in a position raised above the platform 16 to permit the skater to position the skate shoe 17 as well as to provide relative security for the skater's foot. A manual stopping bar 13 is supported from beneath the platform 16. The wheels 10 and 11 are rotationally mounted on axles 22 coaxially extending from opposite sides of the frame 12. Since each wheel 10 and 11 is rotationally mounted through a wheel assembly 20 to a side wall of the frame 12 in an identical manner with identical details of construction only the wheel 10 and wheel assembly 20 will hereafter be discussed at length.

The wheel 10 has a flange 21 which is connected through the wheel assembly 20 to the side wall 14. The wheel assembly 20 includes wheel axles 22 journaled in a bearing assembly 23, located and housed in a swinging arm 24 which is in turn pivotally connected to the side wall 14 through a pin 25. The bearing assembly 23 includes ball bearings 26 and unidirectional needle bearings 27. The ball bearings 26 and unidirectional neelde bearings 27 are of conventional design. The unidirectional needle bearings 27 are commercially available from the Torrington Co. A spacer 28 separates the ball bearings 26 from the needle bearings 27. Conventional clips 33 are used to lock each wheel 10 and bearing assembly 23 on the wheel axle 22.

The swinging arm 24 is mounted to the pin 25 by a bushing 29. The pin 25 is connected to the side wall 14 of the frame 12 by rivet 31. Clips 42 are used to lock the swinging arm 24 on the pin 25. A braking assembly 30 including a brake arm 41 and brake shoe 38 is also connected to the pin 25. The swinging arm 24 is preferably of a two piece construction mounted about the pin 25 on one end thereof and about the bearing assembly 23 on the other end. A standard spring type shock absorber 32 such as is conventionally used in motorcycles is connected to the swinging arm 24 by a pin 34 and to a post 35 extending from the side wall 14.

Figure 2:
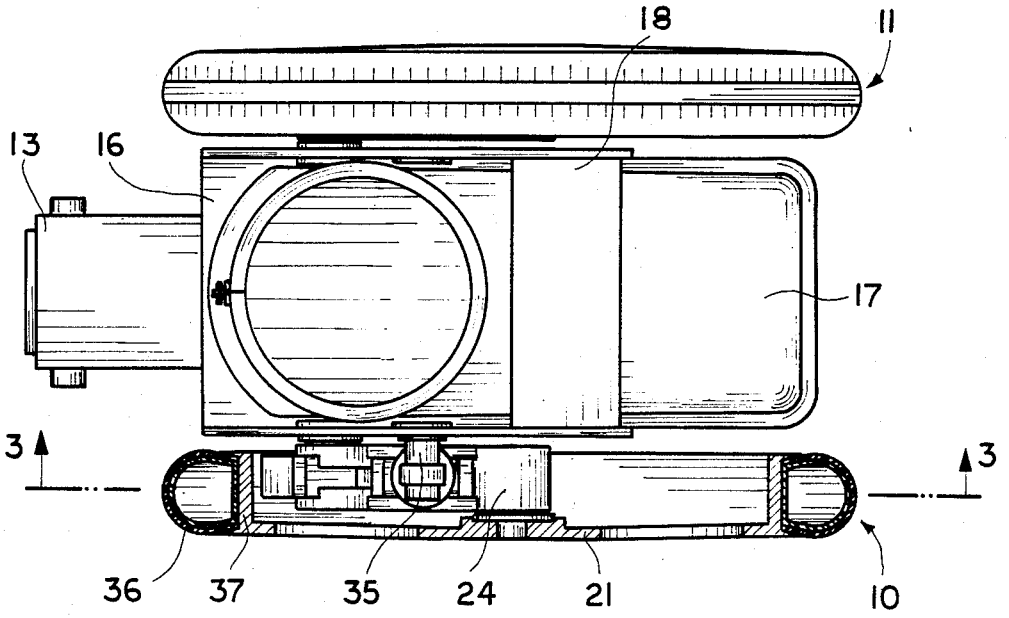
FIG. 2 is a plan view of the two wheel skate device of FIG. 1 with one of the wheels shown in cross section.
Figure 3:
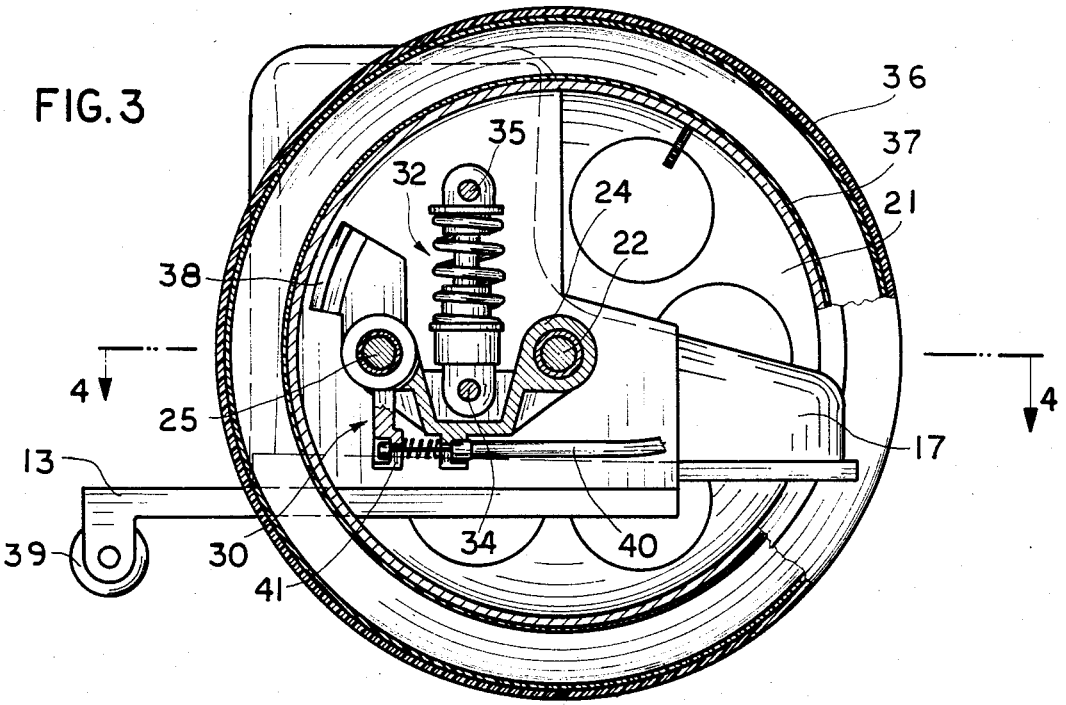
FIG. 3 is a side view of FIG. 2 with a cross section of one wheel taken along the lines 3—3 of FIG. 2.

The outer rim 37 of the wheel 10 supports a pneumatic tire 36 which surrounds the outer flange 21 of the rim 37. The outer rim 37 is circular and extends inward toward the side wall 14 as shown in FIGS. 2 and 3 for making contact with the brake shoe 38 upon manually actuating a mechanical brake cable 40. The brake cable 40 may be operated in a conventional manner.

Operation is best understood from FIGS. 1, 2 and 3 from which it is apparent that both wheels 10 and 11 are balanced and coaxially mounted on opposite sides of the frame 12 with the platform 16 disposed below the center of rotation of the wheels 10 and 11. When on a level terrain the center of rotation of the wheels is at the same height as the pin 25. Any surface undulation will shift the relative vertical position between the wheels 10 and 11 and the frame 12 which will cause the frame 12 through the swinging arm 24 to follow dampened by the action of the shock absorber 32.

Figure 5:
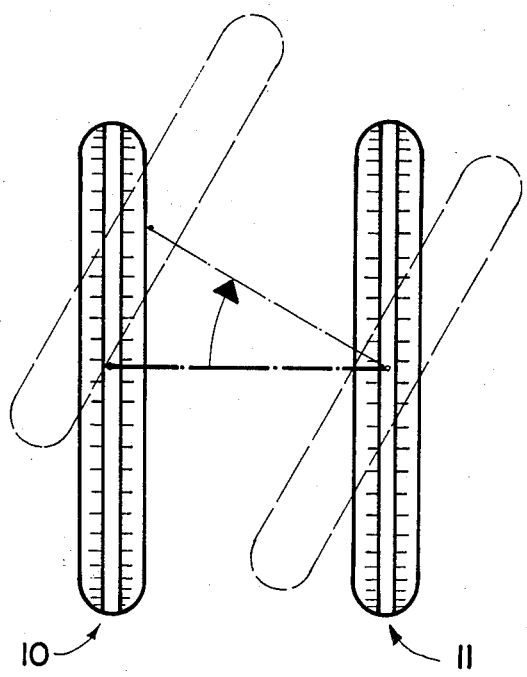
FIG. 5 is a diagrammatic view of the skate of FIG. 1 shown in a straight position using solid lines and in a turned position using dotted lines.
Figure 6:
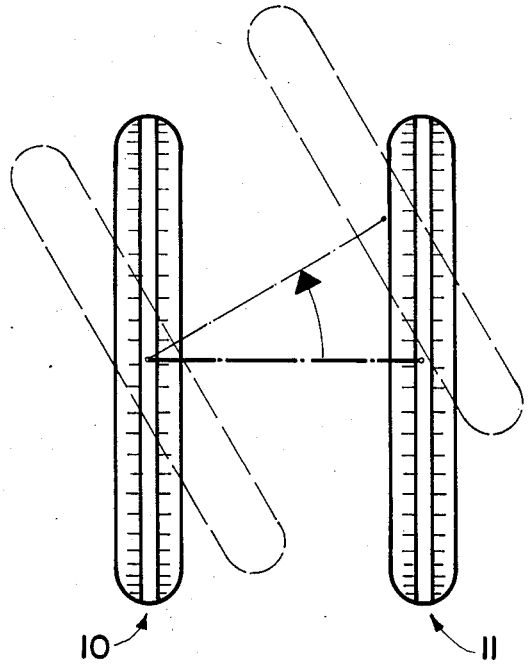
FIG. 6 is a similar diagrammatic view of the skate as shown in FIG. 5 showing the opposite turned position.

The unidirectional needle bearings 27 permit the two wheels 10 and 11 to rotate in only one direction, i.e., either forward or backward. Accordingly, traveling upgrade is no problem and turning does not require shuffling the skates between the skater's feet. Instead as shown in FIGS. 5 and 6 the skater only has to apply a turning force on the skate the skater wishes to turn and it will turn about the other skate. In the preferred operation the skater has one skate on each foot and turns right simply by applying turning force on the right wheels. The converse is done to turn left.

The turning force is caused by shifting weight on the skate that the skater wishes to turn. Since the wheel axle of each wheel assembly is offset from the axis through the pin 25 of the swing arm 24 i.e. the suspension axis as shown in FIGS. 1 and 2, the skate will turn when weight is shifted off the center. The reason the skate turns is not exactly known, although it is believed to be due to the change in position of the suspension axis and the wheels relative to the horizontal. Shifting weight on to the left side of the skate will cause the skate to turn left.

The bar 13 on each skate has a fixed elastomeric roll 39 on its end to permit emergency stopping in the conventional manner by making contact between the fixed roll 39 and the ground surface.

I claim:

1. A two wheel skating device comprising:

a frame adapted to accommodate the foot of a skater;

a first and second wheel;

wheel assembly means for rotationally mounting said first and second wheel on opposite sides of said frame, said wheel assembly means including a wheel axle for each wheel, ball bearings mounted on each axle and unidirectional needle bearings for each wheel to permit rotation of said first and second wheel in only one direction; and suspension means for pivotally coupling each wheel axle to said frame with each suspension means having a suspension pivot axis which is offset from each wheel axle such that each wheel axle is displaced relative to the suspension axis to cause the skate to turn based upon the distribution of the weight of the foot on the frame, said suspension means including a swinging arm for each wheel, with each swinging arm being connected at one end about said wheel axle and pivotally connected at the other end about said suspension axis to said frame.

2. A two wheel skating device as claimed in claim 1 wherein said first and second wheel each have a diameter of over at least about 4 inches.

3. A two wheel skating device as claimed in claim 2 wherein said unidirectional needle bearings are disposed adjacent said ball bearings.

4. A two wheel skating device as claimed in claim 3 further comprising shock absorber means connected to said frame and to said swinging arm for dampening the relative vertical motion between said first and second wheel and said frame.

5. A two wheel skating device as claimed in claim 4 wherein said swinging arm is connected to said frame through a pin.

6. A two wheel skating device as claimed in claim 5 wherein each wheel has a rim and a tire mounted over said rim.

7. A two wheel skating device as claimed in claim 6 further comprising manually operated brake means connected to said swinging arm about said pin with said brake means having a brake shoe for engaging the rim of said wheel upon actuation of said brake.

* * * * *